US005463821A

United States Patent [19]

Gauer

[11] Patent Number: 5,463,821

[45] Date of Patent: Nov. 7, 1995

[54] METHOD AND APPARATUS FOR OPERATING A MICROWAVE DRYER

[75] Inventor: Joseph A. Gauer, Buchanan Township, Berrien County, Mich.

[73] Assignee: Whirlpool Corporation, Benton Harbor, Mich.

[21] Appl. No.: 367,836

[22] Filed: Jan. 3, 1995

[51] Int. Cl.[6] ..... F26B 3/34; H05B 6/64

[52] U.S. Cl. ..... 34/261; 34/260; 34/602; 219/679; 219/752

[58] Field of Search ..... 34/260, 261, 596, 34/599, 602; 219/752, 753, 762, 679

[56] References Cited

U.S. PATENT DOCUMENTS 3,427,422 2/1969 Muller ..... 219/753 X
3,777,095 12/1973 Muranaka ..... 219/752 X
4,057,907 11/1977 Rapino et al. ..... 34/261
4,714,811 12/1987 Gerling et al. ..... 219/751
4,795,871 1/1989 Strattan et al. ..... 219/10.55 F
5,187,879 2/1993 Holst ..... 34/261

*Primary Examiner*—Edward K. Look
*Assistant Examiner*—Hoang Nguyen
*Attorney, Agent, or Firm*—Hill, Steadman & Simpson

[57] ABSTRACT

A method and apparatus for operating a microwave dryer having a rotating drum with radially inwardly extending baffles for tumbling and turning over clothes, the baffles housing microwave magnetron tubes for emitting microwaves into the drum. Air can be circulated through the drum via air passages through the baffles and into the drum. The air drawn through the baffles also cools the magnetron tubes. An inner door closes the drum tightly and rotates with the drum. An outer door closes the cabinet entry and is rotatably connected to the inner door.

18 Claims, 1 Drawing Sheet

METHOD AND APPARATUS FOR OPERATING A MICROWAVE DRYER

BACKGROUND OF THE INVENTION

The present invention relates to a microwave clothes dryer, particularly to a clothes dryer having a rotating drum having radially inwardly extending baffles and in which air is introduced into the drum and moist air is removed for drying clothes. Microwave energy is introduced into the drum to heat the wet clothes to remove moisture.

It is important in the design of a microwave clothes dryer that microwave power is transferred to the wet clothing uniformly to avoid hot spots in the fabric mass. It is advantageous then to provide multiple magnetron tubes for radiating a common chamber. Multiple magnetrons are suggested in U.S. Pat. Nos. 4,795,871 and 4,771,156 but these patents disclose magnetron tubes which are mounted stationary with respect to the dryer. Separate tumbler containers or drums are suggested for placing within the microwave chamber.

Other microwave dryers are disclosed in, for example, U.S. Pat. Nos. 4,703,565; 4,490,923; 4,510,697; 4,765,066; and 4,250,628. These patents disclose microwave dryers having stationary microwave magnetrons arranged to transmit microwave energy into the drums. These devices typically require a complicated and involved sealing arrangement between a rotating drum and a stationary closure member or magnetron support.

SUMMARY OF THE INVENTION

It is an object of the present invention to provide a microwave clothes dryer which is economical to manufacture and maintain. It is an object to provide a microwave clothes dryer which is effective in drying clothes. It is an object to provide a microwave dryer which maintains a microwave sealed integrity for safe operation and a long useful life. It is an object to provide a microwave clothes dryer which eliminates a rotating seal at a clothes access opening. It is an object of the present invention to provide a microwave dryer which does not require a separate inside tumbling container.

An object of the invention is achieved in that a clothes dryer is provided having a rotatable drum closeable by an inner door, the inner door arranged to rotate with the drum. The inner door is rotationally connected to an outer conventional dryer door such that opening of the outer door also opens the inner door to access an inside of the drum. Closing the outer door thereupon closes securely the inner door to the drum whereupon a stationary seal is effected between the inner door and the drum to prevent egress of microwaves during operation. Because the inner door rotates with the drum, a long life can be expected from the seal, no rotational frictional deterioration being present between the inner door and the drum.

An object of the invention is achieved in that at least one microwave magnetron is installed into a drum baffle, inside an outer circumference of the drum. The drum provides a perforated air inlet at each baffle and the baffles are also perforated to allow air to pass through the baffle to cool the magnetron tubes and to pass into the drum through and around clothes tumbling therein. Moist air passes from the drum, out through a microwave blocking screen and through an axially arranged but stationary duct. A lint removing filter can be used downstream of the drum as is known. A felt seal surrounds the axially arranged duct to seal against the rotating drum to prevent leakage of moist air.

The microwave magnetron is electrically powered by two electrical contact rings placed around the drum for rotation therewith, and in contact with stationary wiper contacts or brushes connected to a source of power.

DETAILED DESCRIPTION OF THE PREFERRED EMBODIMENTS

Figure 1:
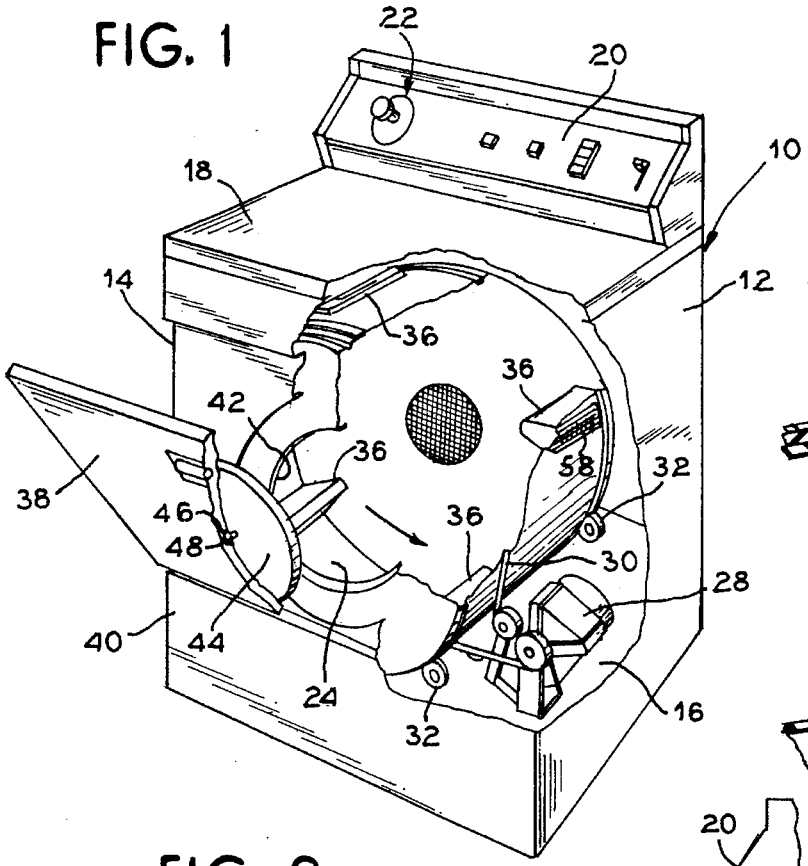
FIG. 1 is a perspective view of a clothes dryer according to the present invention, with portions removed for clarity.
Figure 4:
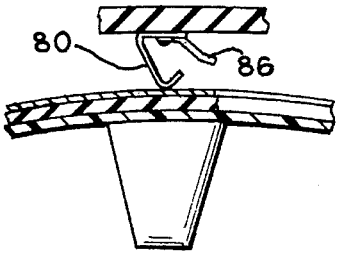
FIG. 4 is a partial sectional view taken generally along lines IV—IV of FIG. 2.
Figure 3:
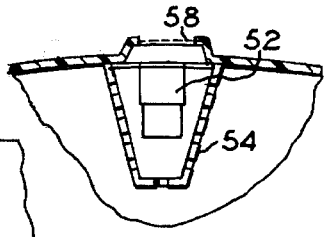
FIG. 3 is a partial sectional view taken generally along lines III—III of FIG. 2.

FIG. 1 illustrates a dryer 10 having side walls 12, 14, a base 16 and a top wall 18. A control panel 20 extends above the top wall. Controls shown generally at 22 on the panel 20 are used to adjust the environment within a rotatable drum 24, such as drum temperature, rotation time, rotation speed, etc., as is known. A motor 28 circulates a belt 30, wrapped around the drum, to rotate the drum 24. The drum is supported by drum rollers 32.

Inside the drum 24 are arranged four baffles 36 extending radially inwardly, which turn-over and tumble clothing held within the dryer in a conventional manner. An outside door 38 is hinged to front panel 40 to access an access port 42 for depositing and removing clothing in/from the drum 24. An inner door 44 is connected to the outer door 38 via a ball 46 and socket 48 joint.

Figure 2:
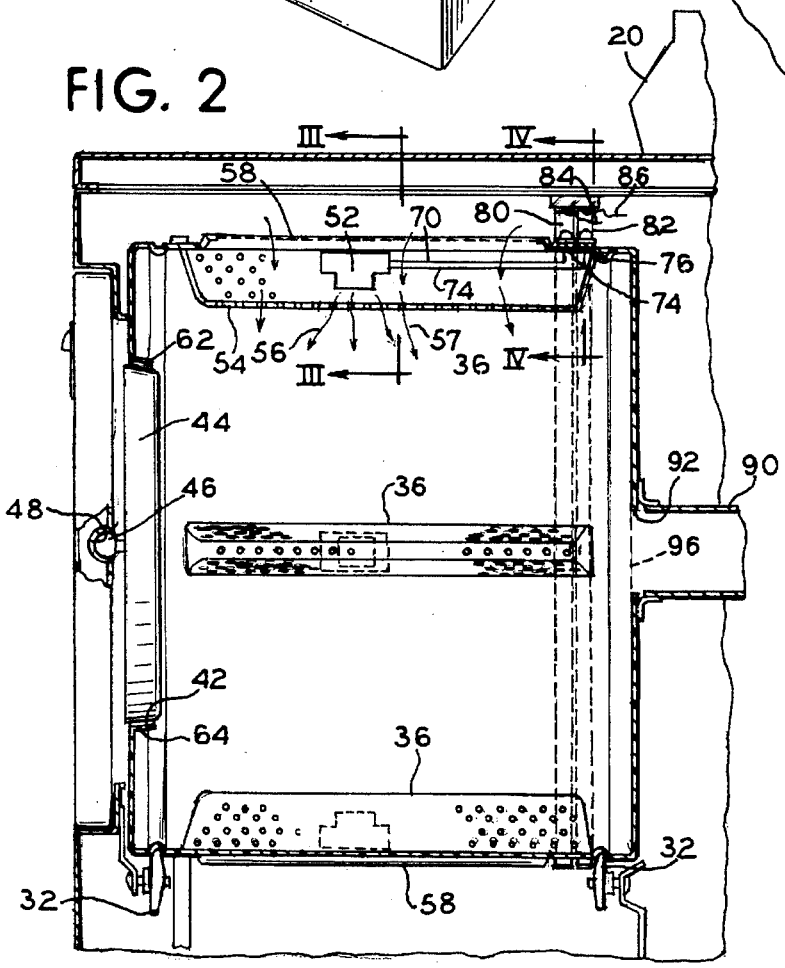
FIG. 2 is a partial sectional view of the dryer of FIG. 1.

FIG. 2 illustrates that at least one and preferably four baffles 36 have microwave magnetron tubes 52 carried within. These tubes 52 rotate with the drum 24 and baffles 36. Each baffle 36 has a perforated wall 54 surrounding the tube 52 within the drum 24 to allow passage of the microwaves 56 and air 57 therethrough. The drum 24 has a perforated air inlet region 58 at each baffle 36 for passing air from outside the drum 24 into the drum, through the baffles 36.

The inner door 44 provides a circumferential seal 62 to seal against a lip 64 surrounding the access port 42. Because the inner door 44 rotates with the drum 24, the seal 62 does not need to resist rotatory friction and wear, such as would a rotating seal (for example, if the door 44 was a stationary door). Also, since the inner door in effect "plugs" into the port 42, no special requirements or discontinuities in the seal are required to accommodate, for example, a hinge. The sealing force around the perimeter of the port 42 is relatively constant.

To provide power to the magnetron tubes 52 within each baffle, wires 70, 72 are arranged connected to contact rings 74, 76 surrounding and connected to an outside of the drum 24. The rings are electrically insulated from the drum and each other. Wiper contacts or brushes 80, 82 make electrical contact with the respective rings 74, 76 and are respectively connected to wires 84, 86 which deliver power to the contact rings via the appropriate controls 22. Power can be supplied, for example, by household current. In this way, all four tubes 52 can be supplied with power.

An air outlet duct 90 is mounted stationary with respect to the dryer cabinet 10 and arranged axially aligned with an outlet opening 92 through the dryer drum 24. Covering the opening 92 is a microwave blocking screen 96 which prevents microwaves from leaving the drum 24 but which allows moist air to leave the drum. An air fan (not shown) is used to draw air through the drum and out the opening 92. A lint filter (not shown) can be installed somewhere downstream of the opening 92 to remove lint before the moist air is transported away from the dryer.

In operation, the air fan (not shown) draws air into the dryer cabinet through an air passage such a perforations in a back wall of the dryer cabinet (not shown). The air is drawn into the inlets 58 arranged at each baffle, passes over the magnetron tubes 52, and through the baffles 36 and into the drum to dry clothes held therein.

Microwave energy heats the water contained in the wet clothing and the air passes over the tumbling clothes as the drum 24 rotates. The resultant moist air leaves the dryer through the opening 90.

Although four magnetron tubes are shown, it is conceivable that only one is used or that more or less than four are used in a dryer. Any number of magnetron tubes are encompassed by the present invention.

Although the present invention has been described with reference to a specific embodiment, those of skill in the art will recognize that changes may be made thereto without departing from the scope and spirit of the invention as set forth in the appended claims.

I claim as my invention:

1. An appliance for conditioning articles with microwaves, comprising:

a drum for receiving articles;

a means for rotating the drum;

at least one magnetron tube mounted to said drum for emitting microwaves into said drum; and means for conducting electric power to said rotating magnetron tube.

2. The appliance according to claim 1 further comprising means for circulating air through said drum.

3. The appliance according to claim 2 wherein said drum has an encircling side wall and said means comprises an air passage through said side wall, said air passage arranged to direct an air flow over said magnetron tube.

4. The appliance according to claim 1 wherein said drum comprises an encircling side wall, an end wall and a front wall, said front wall having an access port therethrough and said appliance comprises an outer door and an inner door, said outer door hingedly moveable with respect to said drum, and said inner door pluggable into said port to close said drum, said inner door connected to said outer door with a rotational connection.

5. The appliance according to claim 4 wherein said drum further comprises an air exit through said back wall, coaxial with an axis of rotation of said drum and covered with a microwave blocking screen.

6. A clothes dryer comprising:

a cabinet;

a drum having an opening for receiving wet clothes, said drum carried within said cabinet;

a means for rotating the drum to tumble said wet clothes;

at least one magnetron tube for emitting microwaves into said drum, said magnetron tube mounted to said drum for rotation therewith; and means for conducting electric power to said rotating magnetron tube.

7. The dryer according to claim 6 further comprising means for circulating air through said drum.

8. The dryer according to claim 7 wherein said drum has an encircling side wall and said means comprises an air passage through said side wall, said air passage arranged to direct an air flow over said magnetron tube.

9. The dryer according to claim 6 wherein said drum comprises an encircling side wall, an end wall and a front wall, said front wall having a clothes access port therethrough and said dryer comprises an outer door and an inner door, said outer door hinged to said cabinet and said inner door pluggable into said port to close said drum, said inner door connected to said outer door with a rotational connection.

10. The dryer according to claim 9 wherein said drum further comprises an air exit through said back wall, coaxial with an axis of rotation of said drum and covered with a microwave blocking screen.

11. The dryer according to claim 6 further comprising a baffle inside said drum for tumbling clothes and wherein said magnetron tube is mounted within said baffle, said baffle having holes to pass microwaves.

12. The dryer according to claim 11 wherein said drum comprises air holes through said side wall into said baffle.

13. The dryer according to claim 12 wherein said cabinet comprises a generally rectangular box with a hinged drum access door which includes an outer door and an inner door, said inner door pluggable into said access port of said drum to close said drum upon pivotal closing of said outer door, said outer and inner door connected by rotative joint.

14. A clothes dryer, comprising:

a cabinet having right and left side panels, a front panel with an access opening therethrough, and a top panel;

a cylindrical drum mounted within said cabinet, with its central axis horizontal and having an encircling side wall, an end wall and a front wall with an access port open to said access opening, and an air exit port, said cylindrical drum mounted for rotation within said cabinet;

a plurality of baffles arranged inside said drum, extending radially therein, connected to said side wall and having a perforated wall structure;

a plurality of perforated regions on said encircling side wall in registry with said baffles;

at least one microwave magnetron tube mounted within one baffle and rotatable with said drum for supplying microwave energy to said clothes;

a means for conducting electric power to said magnetron tube;

a means for conducting air through said perforated regions, through said baffles, through said drum and out said air exit port; and a door structure for closing said access port.

15. The dryer according to claim 14 wherein said at least one magnetron tube comprises a plurality of magnetron tubes, located in a plurality of baffles.

16. The dryer according to claim 14 wherein said door structure comprises an outer door hinged to said front panel and an inner door rotationally connected to said outer door and pluggable to said access port when said outer door is hingedly closed to close said access opening.

17. A method of drying clothes comprising the steps of:

placing said clothes into a drum;

rotating said drum;

providing a microwave magnetron tube arranged to rotate with said drum and to emit microwave energy into said drum;

powering the magnetron tube to emit microwaves into said drum; and circulating outside air through said drum to remove moist air.

18. The method according to claim 17 wherein said step of circulating air is further defined in that said air is circulated past said magnetron tube to cool said tube.

* * * * *